US007160142B2

(12) United States Patent
Hughes et al.

(10) Patent No.: US 7,160,142 B2
(45) Date of Patent: Jan. 9, 2007

(54) GROUNDING CLAMP APPARATUS AND METHOD

(75) Inventors: David C. Hughes, Rubicon, WI (US); Brian T. Steinbrecher, Brookfield, WI (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 11/029,847

(22) Filed: Jan. 4, 2005

(65) Prior Publication Data

US 2006/0148286 A1 Jul. 6, 2006

(51) Int. Cl.
*H01R 13/00* (2006.01)

(52) U.S. Cl. ..... 439/479; 439/478; 439/803

(58) Field of Classification Search ..... 439/92, 439/478–479, 803

See application file for complete search history.

(56) References Cited

U.S. PATENT DOCUMENTS

| | | | | | |
|---|---|---|---|---|---|
| 1,603,035 | A | * | 10/1926 | Evans | 439/479 |
| 1,669,337 | A | * | 5/1928 | Iler | 439/479 |
| 1,777,395 | A | | 10/1930 | Coon | |
| 1,900,900 | A | * | 3/1933 | Evans | 428/190 |
| 2,253,432 | A | * | 8/1941 | Johnson | 439/803 |
| 2,508,778 | A | * | 5/1950 | Spears | 439/479 |
| 2,530,299 | A | * | 11/1950 | Hendley | 439/803 |
| 4,133,591 | A | * | 1/1979 | West et al. | 439/479 |
| 4,540,224 | A | | 9/1985 | Maros | 439/99 |
| 4,846,725 | A | * | 7/1989 | Williams et al. | 439/479 |
| 4,934,949 | A | * | 6/1990 | Charneski et al. | 439/387 |
| 5,046,958 | A | | 9/1991 | Brown | |
| 5,188,397 | A | | 2/1993 | Hynes | 285/24 |
| 5,286,211 | A | * | 2/1994 | McIntosh | 439/100 |
| 5,556,299 | A | * | 9/1996 | Finke | 439/479 |
| 6,744,255 | B1 | | 6/2004 | Steinbrecher et al. | 324/511 |
| 2003/0011354 | A1 | * | 1/2003 | Daniel | 324/117 R |

FOREIGN PATENT DOCUMENTS

| | | |
|---|---|---|
| FR | 2578107 | 8/1986 |

OTHER PUBLICATIONS www.cual.co.za/safetyearth.htm, Safety Earthing Equipment, Phase Screw Clamp.*

International Search Report for PCT/US2006/000046, date of mailing Jun. 2, 2006, 2 pages.

* cited by examiner

*Primary Examiner*—Michael C. Zarroli
(74) *Attorney, Agent, or Firm*—Foley & Lardner LLP

(57) ABSTRACT

A grounding clamp provides a direct connection to ground between a power transmission or power distribution apparatus and a nearby ground plane. As a grounding clamp is being attached to the mating interface of a power transmission or power distribution apparatus, the angled gripping surfaces permit an operator to ground the spade from a distance of live-line tool's length from the frontplate of the power apparatus and apply the requisite pressure to the mating interface, providing an easier to attach grounding clamp and a more secure ground connection.

34 Claims, 3 Drawing Sheets

GROUNDING CLAMP APPARATUS AND METHOD

BACKGROUND

The present invention relates generally to the field of grounding devices. More particularly, this invention relates to enhancements in grounding devices for securing a connection between a potentially energized apparatus and a ground point, while increasing the ease of use of such devices.

RELATED ART

Typically, the distribution of power begins at a power generation facility, such as a power plant. As the power leaves the power plant, it enters a transmission substation, where a transformer converts it up to extremely high voltages for long-distance transmission. Then the power is transmitted over high-voltage transmission lines and is later converted down to distribution voltages that will allow it to be useful to ordinary residential or commercial customers. After the power is converted, the power is transmitted over power lines that typically lead to a switchgear. The switchgear sectionalizes the power amongst various customers in a particular subdivision. The power is then sent to another transformer and reduced from 7,200 volts, which is the voltage typically delivered over a distribution bus line, down to the 240 volts necessary for ordinary residential or commercial electrical service.

Grounding clamps are used to connect the mating interface of a power transmission or power distribution apparatus to a nearby ground point. Such a grounding operation is necessary to perform maintenance operations on the mating interface of a power transmission or power distribution apparatus. For instance, examples of such power transmission or power distribution apparatuses could be in the form of a transformer, a switchgear, a sectionalizing cabinet, or other similar equipment performing a like function. For example, a transformer's general purpose is to convert the power transmitted from an energy source to a receiving device to a useful level for service or distribution. In many cases, a transformer reduces high-distribution voltages down to appropriates levels for residential or commercial customers. In other cases, a transformer can boost the generated voltage up to extremely high levels for long-distance transmission. In both cases, such transformers invariably require maintenance. In performing maintenance to a transformer, the mating interfaces, generally, should be grounded.

Power distribution apparatuses typically distribute power through mating interfaces such as universal wells and spades. The universal wells distribute high-voltage power, while the spades distribute low-voltage power. Such apparatuses typically have several spades. In most cases, a spade is torqued into the low-voltage bushing wells, and its primary purpose is to distribute low-voltage power to customers. For example, each spade can send power to several customers in a subdivision. However, when a spade requires maintenance or when an additional customer requires a connection to the apparatus, an operator typically grounds the spade in order to perform such operations.

The process of grounding the mating interface of a power apparatus typically involves a line-crew operator connecting the clamp's grounding cable to a ground rod and mounting the clamp on the spade. Typically, the clamps are provided as C-clamps, with a C-shaped body and a rod inserted through an opening in the C-shaped body. The rod can be turned primarily at one end, in order to increase the pressure exerted on the mating interface by the clamp. When mounting the clamp on a mating interface, the operator typically clamps the mating interface at an angle, referred to as the grasping angle, in order to achieve the necessary surface contact with the mating interface. The grasping angle is the angle of approach for the gripping surfaces of the clamp to grasp a mating interface. Due to the confinements of the grasping angle, it is necessary that an operator work in close proximity to the frontplate or tank wall of the power apparatus to attach or remove the clamp from the mating interface. Nonetheless, it is desirable for an operator to be able to maintain distance from the frontplate or tank wall of the power apparatus when performing such operations.

Accordingly, it should be advantageous to provide a grounding clamp configured to allow for easier removal of the grounding clamp at a distance from the frontplate or tank wall of a power transmission or power distribution apparatus. It would be desirable to provide a grounding clamp and method or the like of a type disclosed in the present application that includes any of these or other advantageous features. It should be appreciated, however, that the teachings herein may also be applied to achieve devices and methods that do not necessarily achieve any of the foregoing advantages but rather achieve different advantages.

SUMMARY

In accordance with one embodiment of the present invention, a grounding clamp comprises a rigid member with a first end and second end and a moveable member inserted through the second end of the rigid member. The moveable member repositions in relation to the first end of the base for clamping with the first end of the base. The first end of the rigid member is configured such that it is not perpendicular to the axis of motion of the moveable member.

Still other advantages of the present invention will become readily apparent to those skilled in this art from review of the enclosed description, wherein the preferred embodiment of the invention is disclosed, simply by way of the best mode contemplated, of carrying out the invention. As it shall be understood, the invention is capable of other and different embodiments, and its several details are capable of modifications in various respects, all without departing from the invention. Accordingly, the figures and description shall be regarded as illustrative in nature, and not as restrictive.

DETAILED DESCRIPTION OF THE EXEMPLARY EMBODIMENTS

Figure 1:
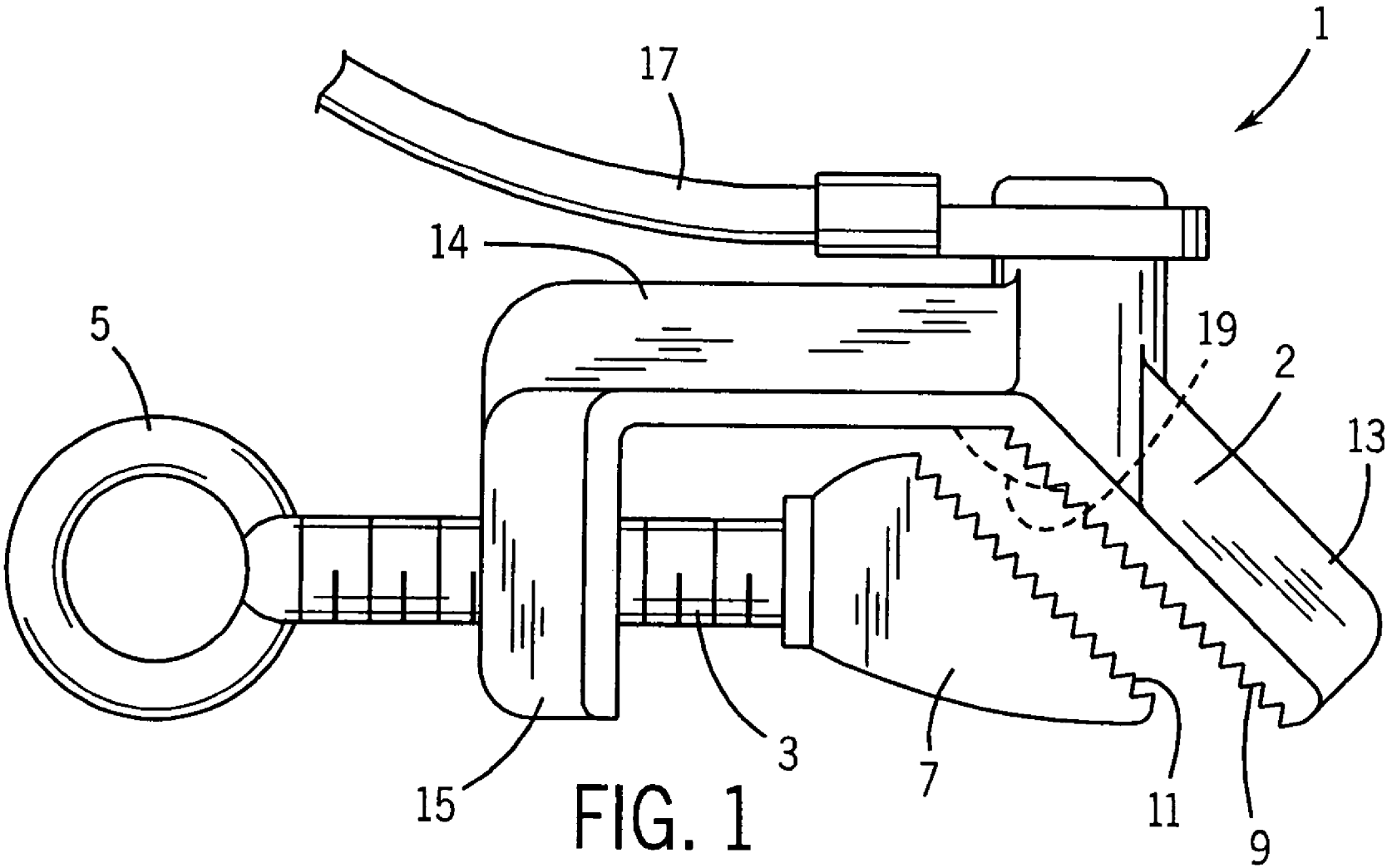
FIG. 1 is a side view of a grounding clamp wherein the C-shaped body has an inner surface with a grasping angle between one-hundred degrees (100°) and less than one hundred and eighty degrees (180°).

Referring to FIG. 1, a grounding clamp 1 is illustrated with an enhanced grasping angle 19. Enhanced grasping angle 19 increases the ease of use of a live-line tool with a grounding clamp 1 for applying pressure to mating interface of power apparatus, such as spade 25 (shown in FIGS. 2 and 3). Grounding clamp 1 is comprised of C-shaped member 2 with a concave inner surface. C-shaped member 2 also has a first end 13, second end 15, and mid-section 14. C-shaped member 2 has an enhanced form, such that the intersection of first end 13 with mid-section 14 result in angle within the range of one-hundred degrees (100°) and one hundred and eighty degrees (180°). FIG. 1 is demonstrative of the embodiment achieved when first end 13 and mid-section 14 intersect at an angle within the preferred range. Grasping angle 19 is ergonomically designed to permit a line-crew operator to apply torque to rod 3, while maintaining the desired clearance between each mating interface and while standing a live-line tool's length away from the power apparatus.

Additionally, the second end 15 of the C-shaped member 2 intersects the opposite end of mid-section 14. The angle created by this intersection is approximately ninety degrees (90°) in the illustrated embodiment, although other configurations may be used. Although C-shaped member 2 is herein disclosed as multiple elements, it may be molded, welded, or cast as a singe unit to achieve the same result. Grounding cable 17 is attached to C-shaped member 2. Grounding cable 17 is connected to a nearby ground point for a secure connection to ground.

Figure 2:
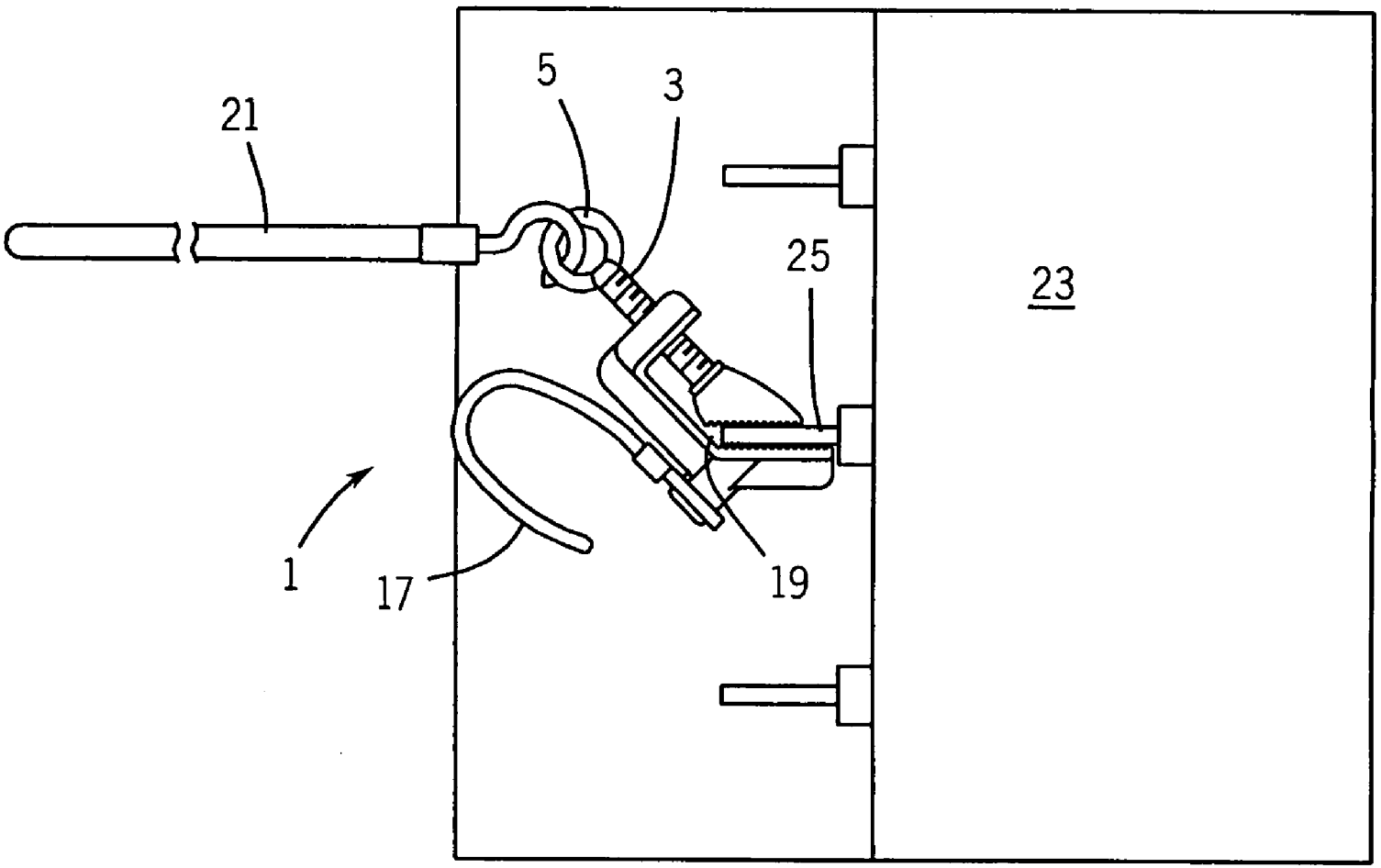
FIG. 2 is an aerial view of the field of use of the grounding clamp with a power apparatus, wherein it is illustrated that the grounding clamp has a grasping angle within the range of one-hundred degrees (100°) and one hundred and eighty degrees (180°).

First gripping surface 9 is formed on the inner surface of the first end 13 of C-shaped member 2. Since it is formed to first end 13, first gripping surface 9 is also correspondingly angled between one-hundred degrees (100°) and one hundred and eighty degrees (180°), in relation to the intersection of first end 13 and mid-section 14. First gripping surface 9 can be formed to the inner surface by most typical means of assembly including, without limitation, molding, welding, casting, gluing, bolting, screwing, fastening, clamping, or being formed integrally with C-shaped member 2, although other arrangements may also be used. On the second end 15, rod 3 is inserted through an aperture in second end 15 of C-shaped member 2. Rod 3 has a first end and second end, whereon rod 3 has a torque ring 5 affixed to second end of rod 3, through which a live-line tool 21 may be attached, as shown in FIG. 2. Torque ring 5 may also be implemented as a single molded component with rod 3.

As illustrated in FIG. 1, jaw 7 is attached to the first end of rod 3. Jaw 7 has an upper surface and a bottom surface, where the bottom surface is affixed to the first end of rod 3. A second gripping surface 11 is affixed to the upper surface of jaw 7. Second gripping surface 11 is angled between one-hundred degrees (100°) and one hundred and eighty degrees (180°), similar to first gripping surface 9. First gripping surface 9 is aligned to meet up with second gripping surface 11 of jaw 7 when torque is applied to rod 3. Application of torque to rod 3 causes jaw 7 and second gripping surface 11 to advance in the direction toward first gripping surface 9. The movement of jaw 7 and second gripping surface 11 toward first gripping surface 9 allows pressure to be applied to a spade positioned between the gripping surfaces for secure grounding. Torque is applied by receiving a fastening hook of live-line tool 21 into torque ring 5 and by rotating torque ring 5 for increased pressure on spade 25. First gripping surface 9 and second gripping surface 11 can be provided in the form of most typical means for gripping surfaces, including without limitation, being serrated, knurled, curved, or flat, although other surface types may also be used.

As mentioned, the angle created by the intersection of first end 13 and mid-section 14 is referred to as the grasping angle 19. Grasping angle 19 is angled between one-hundred degrees (100°) and one hundred and eighty degrees (180°). More specifically, grasping angle 19 is the angle of approach at which the gripping surfaces of grounding clamp 1 clinch a spade. Grasping angle 19 allows the operator to apply torque to rod 3, while standing a live-line tool's 21 distance away from a mating interface in a power apparatus 23.

Figure 3:
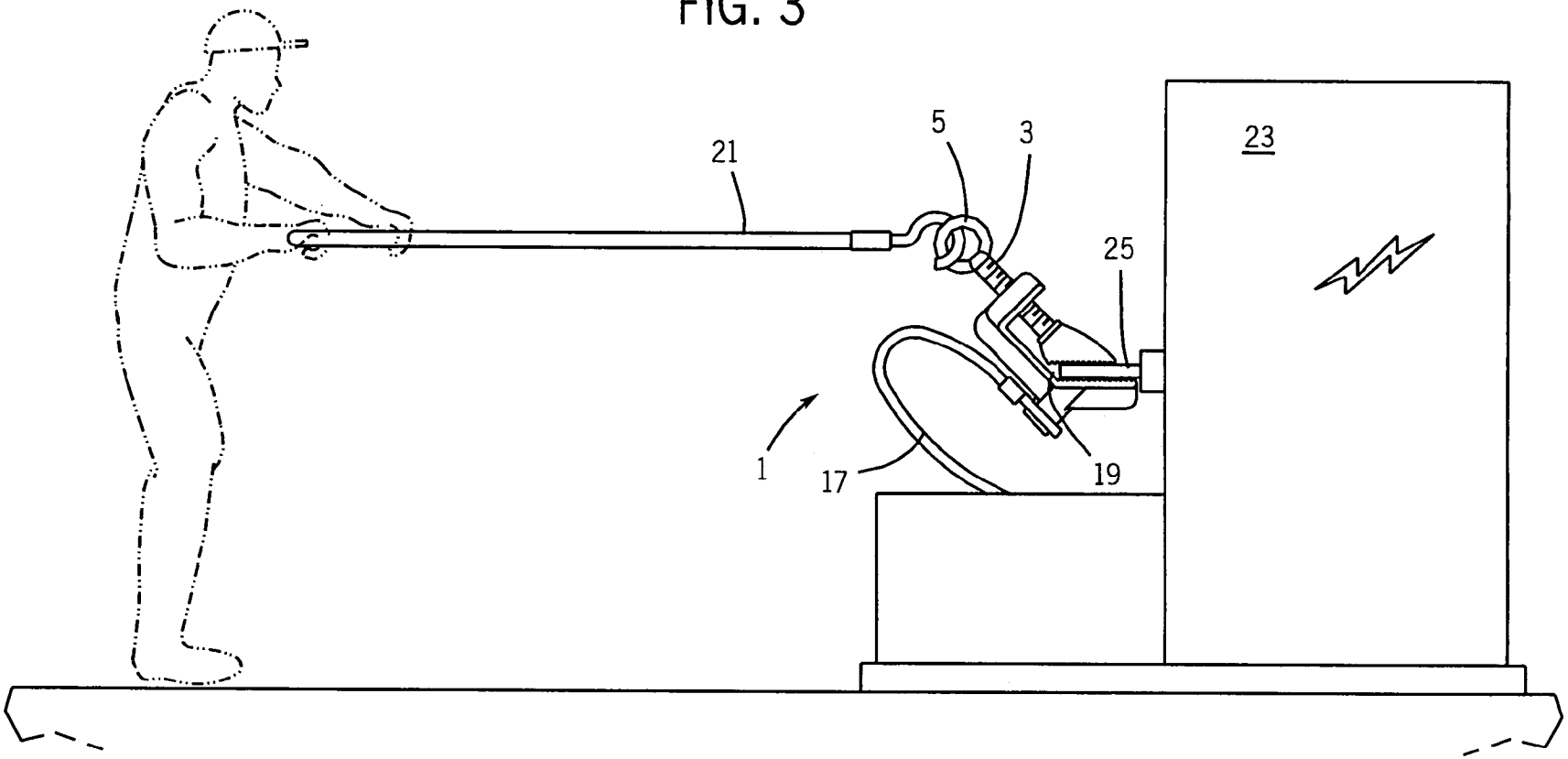
FIG. 3 is side view of the field of use of the grounding clamp with a power apparatus, wherein it is illustrated that the grounding clamp has a grasping angle within the range of one-hundred degrees (100°) and one hundred and eighty degrees (180°).

Referring now to FIGS. 2 and 3, the enhanced grasping angle 19 allows the operator to perform the grounding operation more easily with the combined use of live-line tool 21 and grounding clamp 1. The operator connects grounding cable 17 to a nearby ground point, in order to secure a ground connection. The operator maneuvers grounding clamp 1 onto spade 25. FIGS. 2 and 3 illustrate that torque ring 5 accepts a fastening hook of live-line tool 21. FIG. 2 provides an aerial view of the field of use of grounding clamp 1 with a power apparatus 23, wherein it is illustrated that grounding clamp 1 has a grasping angle 19 within the range of one-hundred degrees (100°) and one hundred and eighty degrees (180°). FIG. 2 further illustrates grasping angle 19 of grounding clamp 1 when spade 25 is rotated nearly vertical to the ground surface over which the power apparatus 23 is situated. FIG. 3 illustrates an operator applying torque to rod 3 with live-line tool 21 and completing the grounding operation while standing a live-line tool's 21 length away from power apparatus 23. Grasping angle 19, which is preferably in the range of one-hundred degrees (100°) to one hundred and eighty degrees (180°), increases the combined ease of use of live-line tool 21 and grounding clamp 1. Grasping angle 19 assists the operator in applying torque to rod 3 with live-line tool 21, and the operator is able to maintain proper distance from spade 25 in power apparatus 23 cabinet, in order to apply torque when using grounding clamp 1.

Throughout the specification, numerous advantages of exemplary embodiments have been identified. It will be understood of course that it is possible to employ the teachings herein so as to without necessarily achieving the same advantages. Additionally, although many features are herein disclosed as multiple elements, it will be appreciated that such features could also be implemented by molding or casting processes to create the claimed feature as a singe unit or assembled as separate components to achieve the same result. Further, although certain methods are described as a series of steps which are performed sequentially, the steps generally need not be performed in any particular order. Additionally, some steps shown may be performed repetitively with particular ones of the steps being performed more frequently than others, when applicable. Alternatively, it may be desirable in some situations to perform steps in a different order than described.

Many other changes and modifications may be made to the present invention without departing from the spirit thereof.

What is claimed is:

1. A grounding clamp comprising:

a rigid member including a first end and second end; and a moveable member having a gripping surface, the moveable member being inserted through an aperture in the second end of the rigid member, wherein the first end of the rigid member is not perpendicular to the axis of motion of the moveable member, the first end of the rigid member and the gripping surface of the moveable member being configured for receiving a substantially flat conductive interface, wherein during receiving of the conductive interface. the gripping surface of the moveable member is configured to be substantially parallel to the conductive interface and the first end of the rigid member.

2. A grounding clamp according to claim 1, wherein the first end of the rigid member comprises a gripping surface.

3. A grounding clamp according to claim 1, wherein the moveable member comprises a threaded, cylindrical rod, wherein the cylindrical rod is threadedly connected to a plurality of threads formed within the aperture of the second end of the rigid member.

4. A grounding clamp according to claim 1, wherein the moveable member has an aperture formed therein which accepts the insertion of a fastening hook of a live-line tool to facilitate the movement of the moveable member.

5. A grounding clamp according to claim 1, further comprising a grounding cable configured to connect the mating interface of the potentially energized apparatus to a grounding point.

6. A grounding clamp comprising:

a base including a first end and second end; and a moveable member having a gripping surface, the moveable member being connected to the second end of the base for clamping with the first end of the base, the first end of the base and the gripping surface of the moveable member being configured for receiving a substantially flat conductive interface, such that during receiving of the conductive interface, the first end of the base is configured to be substantially parallel to the conductive interface and the gripping surface of the moveable member;

wherein the grounding clamp is configured to clamp onto a mating interface of a potentially energized apparatus with the use of a live-line tool, while the live-line tool is positioned substantially parallel to the gripping surface of the moveable member throughout the clamping onto the mating interface.

7. A grounding clamp according to claim 6, wherein the first end of the base comprises a gripping surface.

8. A grounding clamp according to claim 7, wherein the gripping surface of the first end of the base is serrated.

9. A grounding clamp according to claim 6, wherein the gripping surface of the moveable member is serrated.

10. A grounding clamp according to claim 6, wherein the moveable member comprises a threaded, cylindrical rod, wherein the cylindrical rod is threadedly connected to a plurality of threads formed within an aperture of the second end of the base.

11. A grounding clamp according to claim 6, wherein the moveable member has an aperture formed therein which accepts the insertion of a fastening hook of a live-line tool to facilitate the movement of the moveable member.

12. A grounding clamp according to claim 6, further comprising a grounding cable configured to connect the mating interface of the potentially energized apparatus to a grounding point.

13. A grounding clamp according to claim 6, wherein the first end of the base is angled between one-hundred degrees (100°) and one hundred and eighty degrees (180°) relative to the axis of motion of the moveable member.

14. A grounding clamp according to claim 6, wherein the first end of the base is angled between one-hundred and twenty degrees (120°) and one-hundred and sixty degrees (160°) relative to the axis of motion of the moveable member.

15. A grounding clamp according to claim 6, wherein the first end of the base is angled between one-hundred and thirty-five degrees (135°) and one-hundred and forty-five degrees (145°) relative to the axis of motion of the moveable member.

16. A grounding clamp comprising:

a rigid member including a first end and second end; and means for clamping a substantially flat conductive mating interface of a potentially energized apparatus to the first end of the rigid member, wherein means for clamping includes a gripping surface, the first end of the rigid member is being angled between one-hundred degrees (100°) and one hundred and eighty degrees (180°) relative to the axis of motion of means for clamping, wherein the gripping surface of the means for clamping is configured to be positioned substantially parallel to the conductive mating interface and the first end of the rigid member.

17. A grounding clamp according to claim 16, further comprising means for connecting the rigid member to a live-line tool, such that the live-line tool is positioned substantially parallel to a ground surface over which it extends, while clamping onto the substantially flat conductive mating interface of the potentially energized apparatus.

18. A grounding clamp according to claim 16, further comprising means for grounding the substantially flat conductive mating interface of the potentially energized apparatus, wherein the means for grounding the mating interface interconnects the rigid member to a grounding point.

19. A grounding clamp according to claim 16, further comprising means for gripping the substantially flat conductive mating interface of the potentially energized apparatus, wherein the means for gripping the mating interface is coupled to the rigid member.

20. A grounding clamp according to claim 19, wherein means for gripping has a serrated surface.

21. A grounding clamp according to claim 16, wherein the first end of the rigid member is angled between one-hundred and twenty degrees (120°) and one-hundred and sixty degrees (160°) relative to the axis of motion of means for clamping.

22. A grounding clamp according to claim 16, wherein the first end of the rigid member is angled between one-hundred and thirty-five degrees (135°) and one-hundred and forty-five degrees (145°) relative to the axis of motion of means for clamping.

23. A grounding clamp comprising:

a generally C-shaped member with three sections including a first end, a second end, and a mid-section, wherein the first end of the C-shaped member connects with a first end of the mid-section, forming an angle on the inner surface of the C-shaped member measured between one-hundred degrees (100°) and one hundred and eighty degrees (180°), and the second end of the C-shaped member joined with a second end of the mid-section, opposite the intersection of the first end;

a first gripping surface connected to the first end of the C-shaped member;

a jaw with an upper surface and a bottom surface, including a second gripping surface on the upper surface; and a rod inserted through an aperture in the second end of the C-shaped member, wherein the rod is connected to the bottom surface of the jaws wherein the first end of the C-shaped member and the jaw are configured for receiving a substantially flat conductive interface, such that the first end of the C-shaped member is configured to be positioned substantially parallel to the conductive interface and the upper surface of the jaw.

24. A grounding clamp according to claim 23, wherein the first end, second end, and mid-section are integrally formed as a single component.

25. A grounding clamp according to claim 23, further comprising a cable to provide a connection with a grounding point.

26. A grounding clamp according to claim 23, wherein the rod comprises advancing spiral threads, wherein the cylindrical rod is threadedly connected to a plurality of threads formed within the aperture of the second end of the base.

27. A grounding clamp according to claim 23, wherein the rod has an aperture formed therein which accepts the insertion of a fastening hook of a live-line tool to facilitate the movement of the jaw.

28. A grounding clamp according to claim 23, wherein the rod is attached to the jaw by a ball-and-socket-type joint.

29. A grounding clamp according to claim 23, wherein the first and second gripping surfaces are serrated.

30. A grounding clamp according to claim 23, wherein the angle formed by the first end of the C-shaped member and the first end of the mid-section is measured between one-hundred and twenty degrees (120°) and one-hundred and sixty degrees (160°) relative to the orientation of the potentially energized apparatus.

31. A grounding clamp according to claim 23, wherein the angle formed by the first end of the C-shaped member and the first end of the mid-section is measured between one-hundred and thirty-five degrees (135°) and one-hundred and forty-five degrees (145°) relative to the orientation of the potentially energized apparatus.

32. A grounding clamp comprising:

a rigid member including a first end and second end, wherein the first end of the rigid member includes a first gripping surface; and a moveable member including a second gripping surface, the moveable member being inserted through an aperture in the second end of the rigid member, the first gripping surface being configured to be non-perpendicular to the axis of motion of the moveable member and substantially parallel to the second gripping surface of the moveable member, wherein the first gripping surface of the rigid member and the second gripping surface of the movable member are configured for receiving a substantially flat conductive interface, such that the first gripping surface of the rigid member is configured to be positioned substantially parallel to the conductive interface and the second gripping surface of the movable member.

33. A grounding clamp comprising:

a base including a first end and second end, the first end of the base having a first gripping surface; and a moveable member having a second gripping surface, the moveable member being coupled to the second end of the base, wherein the first gripping surface of the base is configured to be substantially parallel to the second gripping surface of the moveable member, such that the first gripping surface is configured to clamp with the second gripping surface, wherein the first gripping surface of the base and the second gripping surface of the movable member are configured for receiving a substantially flat conductive mating interface positioned substantially parallel there between the gripping surfaces;

wherein the grounding clamp is configured to clamp onto the substantially flat conductive mating interface of a potentially energized apparatus with the use of a live-line tool, while the live-line tool is positioned substantially parallel to the gripping surface of the moveable member.

34. A grounding clamp comprising:

a generally C-shaped member with three sections including a first end, a second end, and a mid-section, wherein the first end of the C-shaped member connects with a first end of the mid-section, forming an angle on the inner surface of the C-shaped member measured between one-hundred degrees (100°) and one hundred and eighty degrees (180°), and a second end of the C-shaped member joined with a second end of the mid-section, opposite the intersection of the first end;

a first gripping surface connected to the first end of the C-shaped member;

a jaw with an upper surface and a bottom surface, including a second gripping surface on the upper surface; and a rod inserted through an aperture in the second end of the C-shaped member, the rod being connected to the bottom surface of the jaw by a ball-and-socket-type joint.

* * * * *